United States Patent [19]

Mackson

[11] Patent Number: 4,572,639

[45] Date of Patent: Feb. 25, 1986

[54] FILM PROCESSING APPARATUS INCLUDING A CONTROL SYSTEM

[76] Inventor: Richard G. Mackson, 2239 - 26th St., Santa Monica, Calif. 90405

[21] Appl. No.: 630,634

[22] Filed: Jul. 13, 1984

[51] Int. Cl.[4] ..... G03D 3/10

[52] U.S. Cl. ..... 354/322; 354/320; 354/328; 134/76

[58] Field of Search ..... 354/316, 320, 322, 328; 134/56 R, 76

[56] References Cited

U.S. PATENT DOCUMENTS

| | | | |
|---|---|---|---|
| 2,545,031 | 3/1951 | Izzi | 134/76 |
| 2,934,000 | 4/1960 | Sardeson et al. | 134/76 |
| 3,225,675 | 12/1965 | Cross et al. | 134/76 |
| 3,382,520 | 5/1968 | Savart | 134/76 |
| 3,469,517 | 9/1969 | Nishimoto | 354/322 |
| 3,559,553 | 2/1971 | Buechner | 354/322 |
| 4,431,293 | 2/1984 | Riekkinen | 354/322 |

FOREIGN PATENT DOCUMENTS

| | | | |
|---|---|---|---|
| 371089 | 4/1932 | United Kingdom | 354/322 |

*Primary Examiner*—A. A. Mathews

*Attorney, Agent, or Firm*—Keith D. Beecher

[57] ABSTRACT

Computer controlled apparatus for processing exposed photographic film so as to develop, fix, wash and dry the film in a predetermined sequence and on a fully automatic basis. To operate the apparatus, exposed film is loaded onto racks, and the racks are transported by the apparatus so that the film may be successively immersed into a series of tanks which contain appropriate developing, rinsing and fixing solutions. The apparatus is controlled by a computer, or other appropriate control system or mechanism, so that it may process different types of film with the time of immersion for each film in the developing tank being established by the computer in correspondence with the film manufacturer's recommendations. The apparatus includes a first transporter which serves to move the racks from tank-to-tank, and which is activated at fixed time intervals by a timing mechanism (which also clocks the computer); and a second transporter which advances the racks within selected tanks and which is also activated at fixed time intervals under the control of the first transporter, the two transporters cooperating to establish different fixed immersion times of the film in selected tanks other than the developing tank, and for establishing computer controlled different immersion times for different film in the developing tank.

11 Claims, 6 Drawing Figures

FILM PROCESSING APPARATUS INCLUDING A CONTROL SYSTEM

BACKGROUND OF THE INVENTION

The apparatus of the present invention is of the same general type as the apparatus described in U.S. Pat. No. 3,559,553, and like the apparatus described in that patent, it is intended to process photographic film through the various steps of a multi-step process. The apparatus is particularly intended for the fully automatic processing of color photographic film, and the particular embodiment of the invention to be described comprises a color photographic film processing apparatus.

As described in U.S. Pat. No. 3,559,553, photographic color film may be developed by continuous or batch procedures. In the batch procedure, certain well established development schedules are followed, which require the transfer of the film from one tank to another after a predetermined immersion time in each tank under exactly controlled conditions. Manual color film processing procedures are lengthy and time consuming, and require constant attention by the film processing individual.

Many attempts, accordingly, have been made in the past to develop automatic film processing apparatus, which automatically performs the functions of moving the film from one processing tank to another, and for causing the film to be immersed in the various processing tanks for the proper time intervals. The apparatus of the prior art, however, has proven to be relatively rigid in its processing parameters, and difficult to operate.

It is, accordingly, a primary object of the present invention to provide such automatic film processing apparatus which may be operated in a simple manner requiring no particular skill or lengthy attention on the part of the operator, and which is capable of a wide variety of processing parameters.

DETAILED DESCRIPTION OF THE ILLUSTRATED EMBODIMENT

Figure 1:
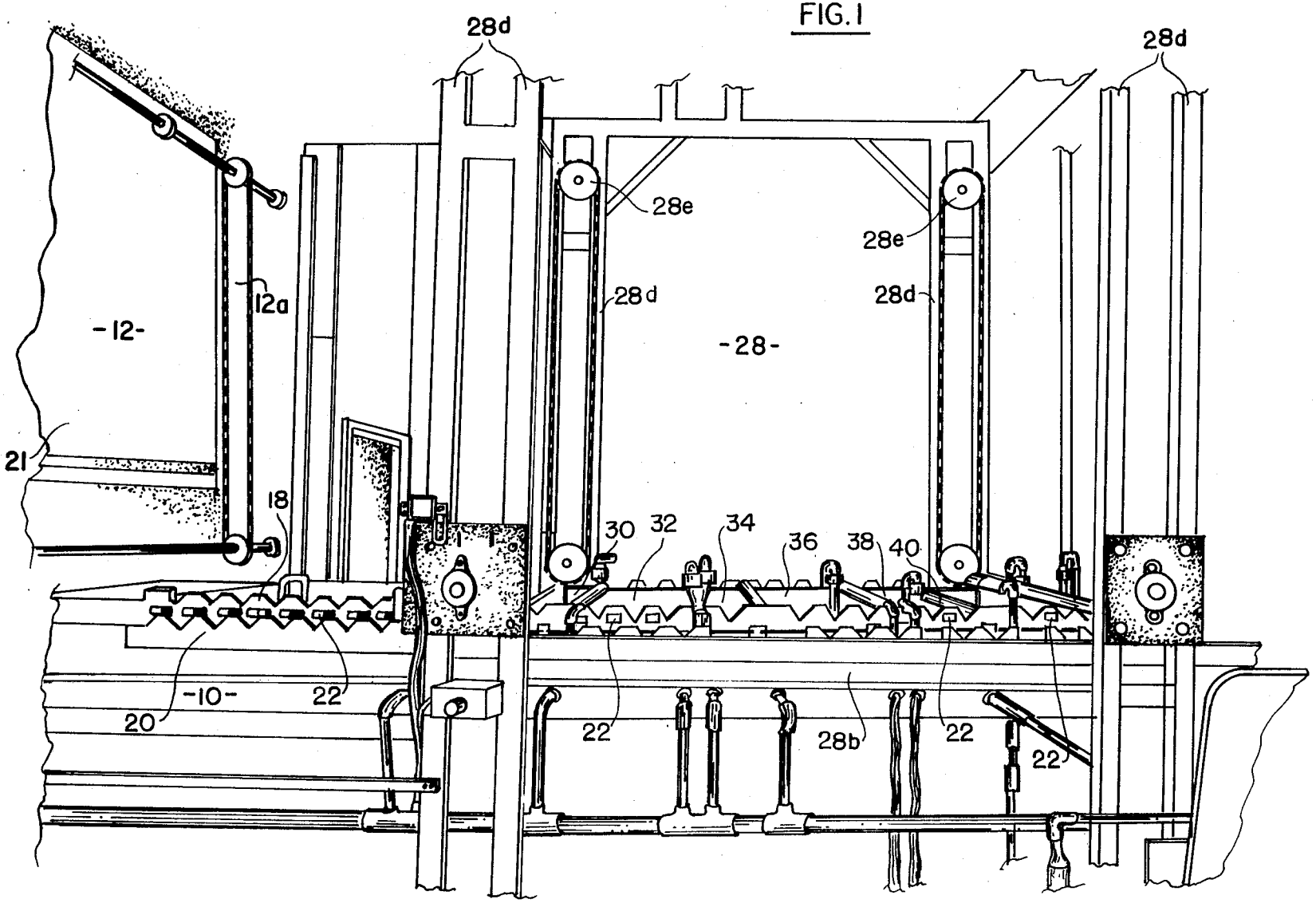
FIG. 1 is a side perspective view of apparatus representing one embodiment of the invention, and showing a series of processing tanks to which exposed color photographic film is automatically transported and immersed for controlled times in the individual tanks.

The particular apparatus to be described is intended to process exposed color photographic film. The apparatus includes a developing tank 10, which is best shown in FIGS. 1, 2 and 3, and which contains an appropriate developing solution.

In the operation of the apparatus, film F is loaded on a spindle 16, and spindle 16 is suspended from a rack 14. The rack and film are then placed in an inserter 12 through a hatch at the bottom of panel 21, and the rack is placed on a pair of V-shaped clips **12*c*, 12*d* carried by chain drives 12*a*, 12*b* of the inserter, when the clips are in a lower position adjacent to the hatch. The computer then activates an electric motor which causes the chain drives 12*a* and 12*b* to move the rack 14 and film F suspended from the rack up to the top of the inserter to the position shown in FIG. 2**.

The inserter 12 is then moved forwardly to a position along tank 10, as determined by the computer, by energizing a drive motor (not shown) for a determined time. This position is established by the computer, and is dependent upon the time the particular film is to be immersed in the developing solution in tank 10. Then, the computer causes the chain drives **12*a*, 12*b* of the inserter 12 to lower the rack 14 to cause the film F to be immersed in the developing solution in tank 10. The inserter 12** is then returned to its original position to receive the next rack.

Figure 2:
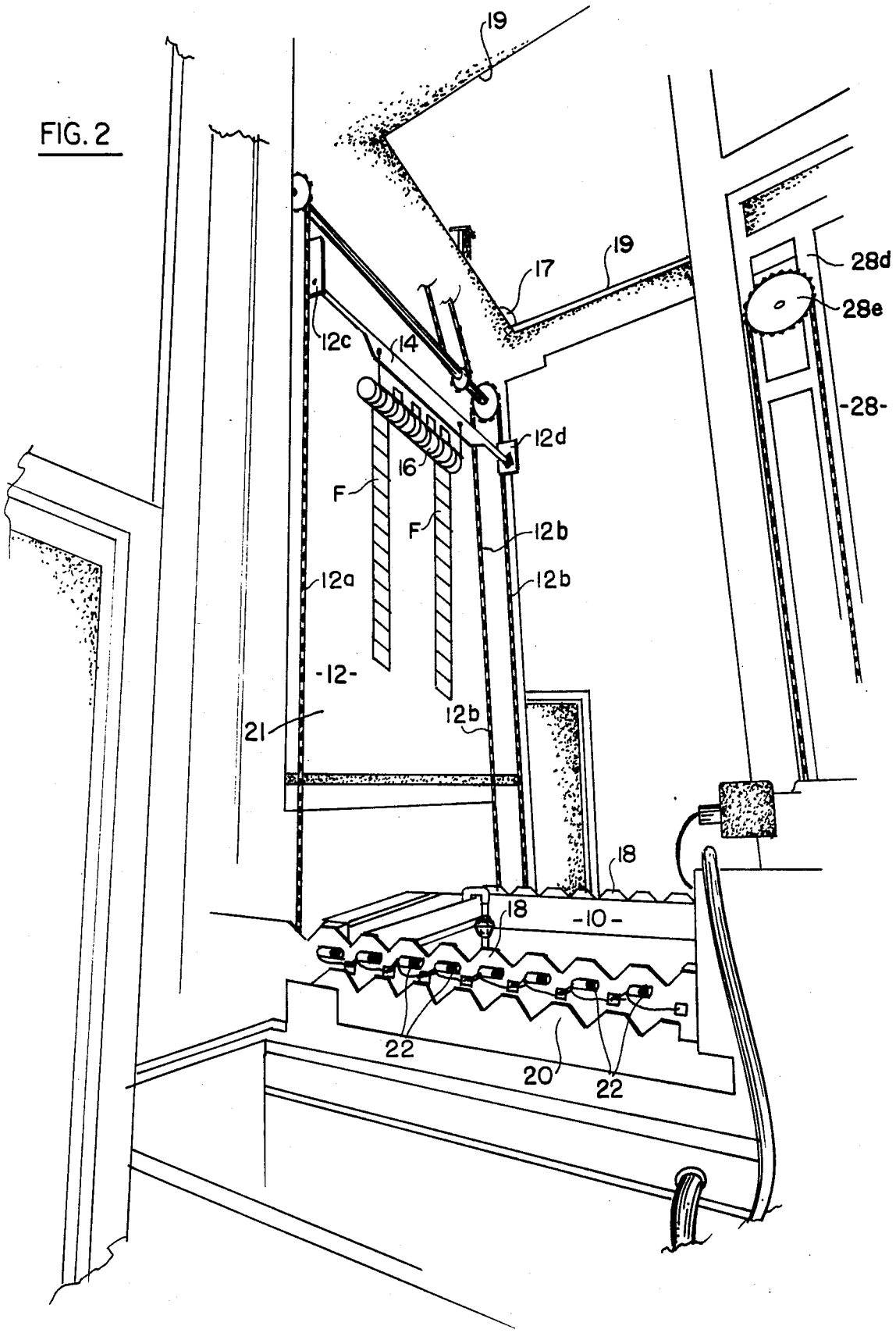
FIG. 2 is a side perspective view of the inserter end of the apparatus, showing an inserter, a developing tank, and the portions of the apparatus adjacent to that tank.
Figure 3:
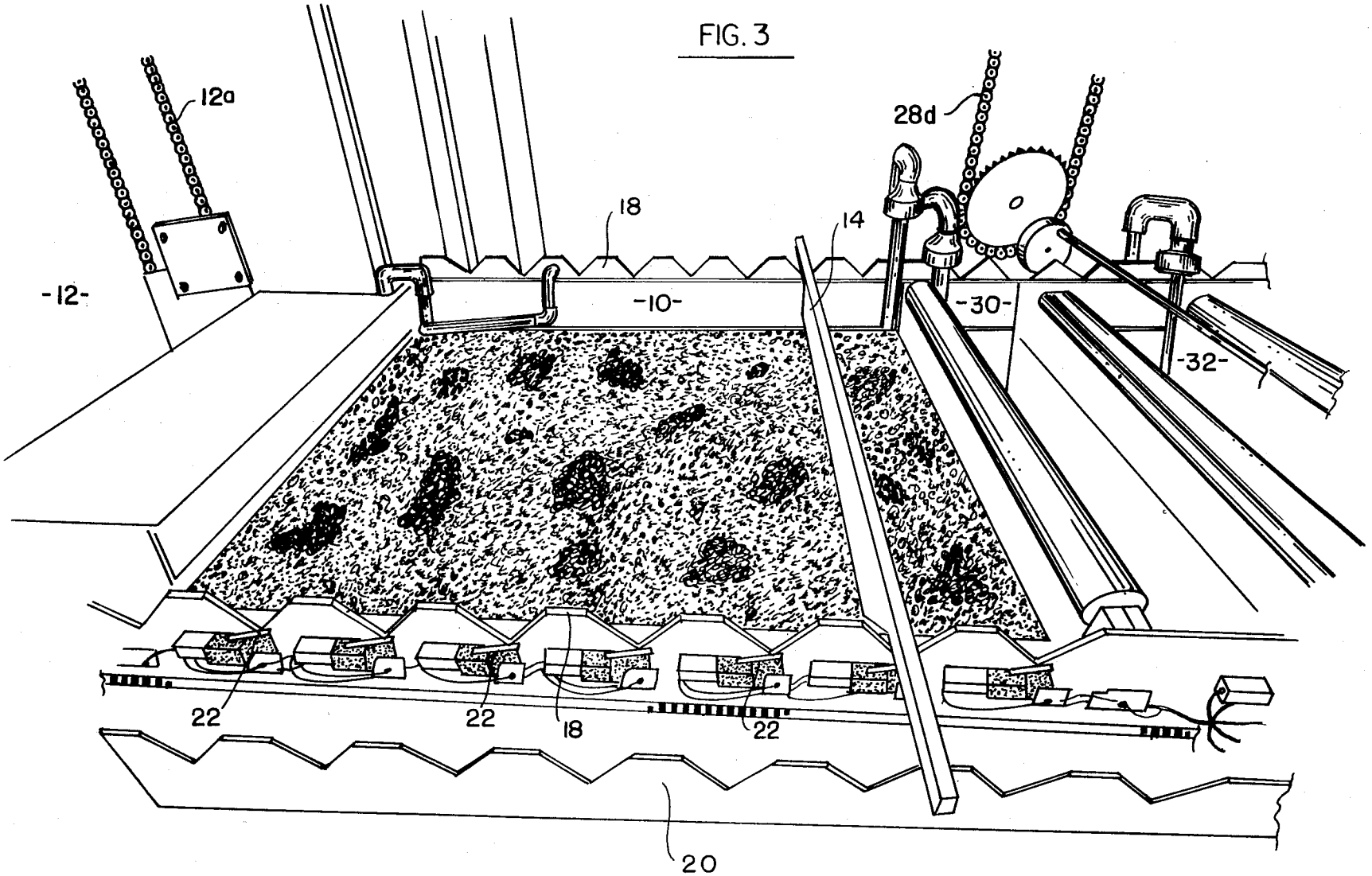
FIG. 3 is a perspective view of the developing tank of FIG. 2, taken from above the tank, and showing an in-tank transporter and a between-tank transporter which are located on each side of the tank.
Figure 6:
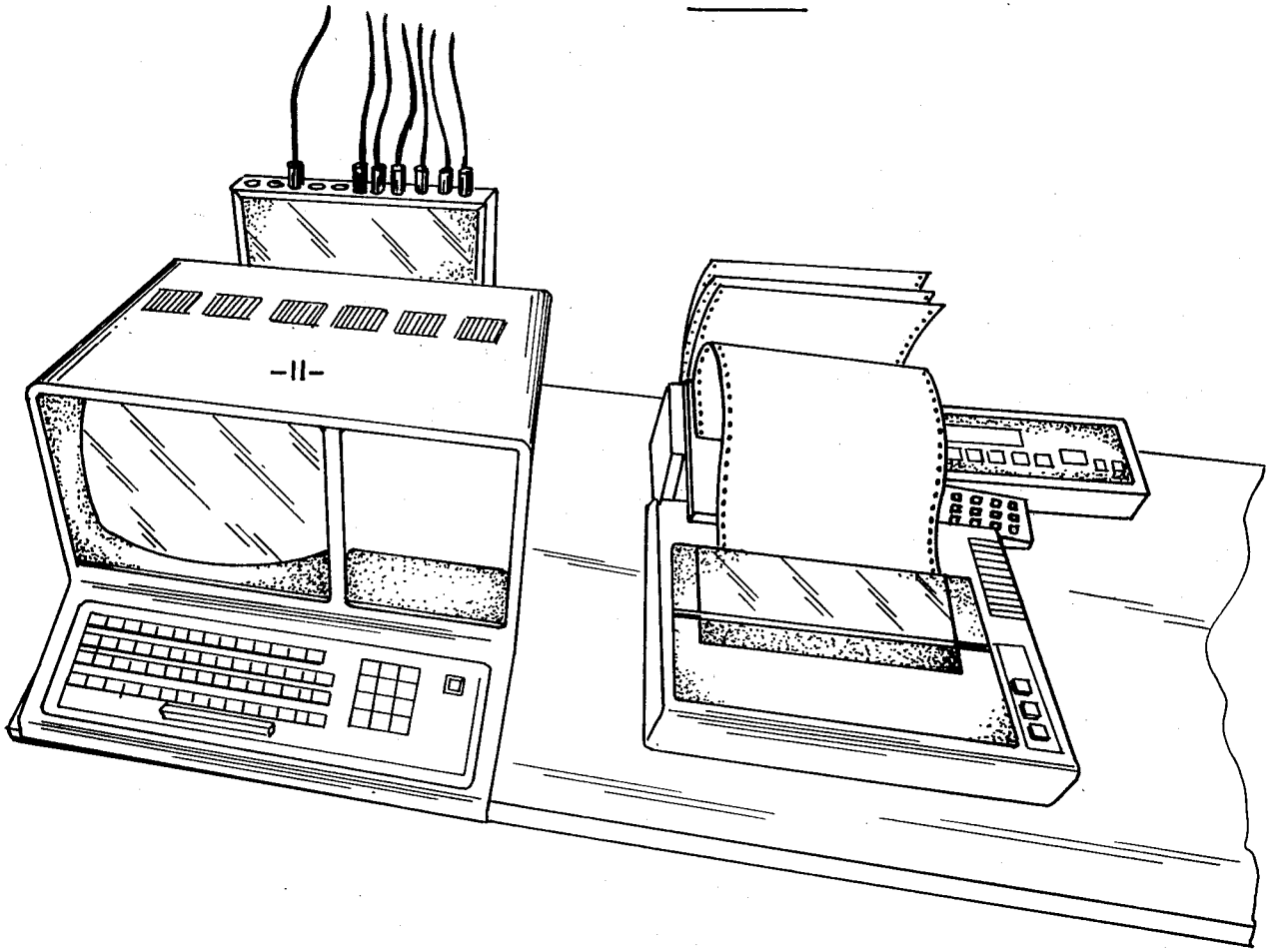
FIG. 6 is a view of a computer which is connected to the inserter to control the operation of the inserter.

As best shown in FIG. 2, inserter 12 serves to transport the racks 14 over the top of tank 10 to respective positions determined by a computer 11 (FIG. 6). Then, after a time interval determined by the computer, each rack 14 is lowered to immerse exposed film F hanging from the rack 14 into the developing solution in the developing tank. The inserter 12 is moved horizontally along tank 10 by an electric motor (not shown) which drives a pair of wheels 17 along spaced and parallel horizontal tracks 19 at the top of the apparatus. The racks 14 are moved vertically by the vertical chain drives **12*a* and 12*b* of inserter 12**.

A notched strip 18 is mounted on each side of tank 10, and when each rack 14 is lowered by the chain drives **12*a*, 12*b* of inserter 12, to immerse its film into the solution in tank 10, it is received in one of the notches of the strip, as selected by the computer, and as best shown in FIG. 3. When a rack 14 is received in a particular notch of strip 18, it actuates a switch 22 to cause nitrogen to be introduced into tank 10** at 30 second intervals to agitate the developing solution in the tank for so long as the film F mounted on that rack is immersed in the developing solution.

An in-tank transporter in the form of an elongated toothed member 20 mounted on each side of the series of tanks, is included in the apparatus. The toothed member 20 is driven in an arcuate manner by an eccentric drive mechanism (not shown) to move first vertically upwardly, then horizontally in a forward direction, and then vertically downwardly, and then back to the original position. This motion of the toothed member 20 of the in-tank transporter, lifts the rack 14 (FIG. 3) upwardly, and then forwardly, and then drops the rack in the next notch of strip 18, while the film F remains immersed in the developing solution of tank 10. The eccentric drive of the in-tank transporter 20 is driven by a between-tank transporter mechanism which will be described.

Accordingly, if the film F carried by a particular strip 14 is to remain in the developing solution in tank 10, for example, for 6 minutes and 18 seconds, the computer causes inserter 12 to move forward to a predetermined position over tank 10, and the computer then causes the chain drives 12*a*, 12*b* to lower rack 14 so that the film F may be immersed into the solution in tank 10, and the rack 14 to be received in a selected notch in strip 18. When that occurs, switch 22 is actuated, so as to control the introduction of nitrogen into the tank to set up the agitating action of the solution, as explained above.

Since the in-tank transporter 20 is operated at fixed time intervals, for example, at 2 minute intervals, as will be described, the computer controls the chain drives 12*a*, 12*b* of inserter 12 so that the film F is immersed into the solution in tank 10, for example, 1 minute and 42 seconds after the previous movement of the transporter 20. The notch of the rack 18 is selected by the computer, in the particular example referred to above, so that four successive operations of the in-tank transporter 20 are required to advance the carrier from notch-to-notch in the rack 18 at 2 minute intervals, unitl the rack is finally deposited in the notch of the rack adjacent to the forward wall of tank 10.

The rack 14 is now in position to be picked up by a between-tank transporter 28 (FIG. 1) and carried to the next tank 30. The operation of the transporters 20 and 28 is synchronized, as will be described, so that each rack is moved by transporter 20 to the notch of strip 18 adjacent to the forward wall of tank 10 for the final 2 minutes of the preset 6 minute-18 second interval, after the preceding rack has been lifted out of that notch by transporter 28. The rack is then removed from the tank 10 by the transporter 28, and its film F is then immersed by transporter 28 in the next tank 30 (FIGS. 1, 3 and 4) which contains an appropriate solution for washing purposes.

Figure 4:
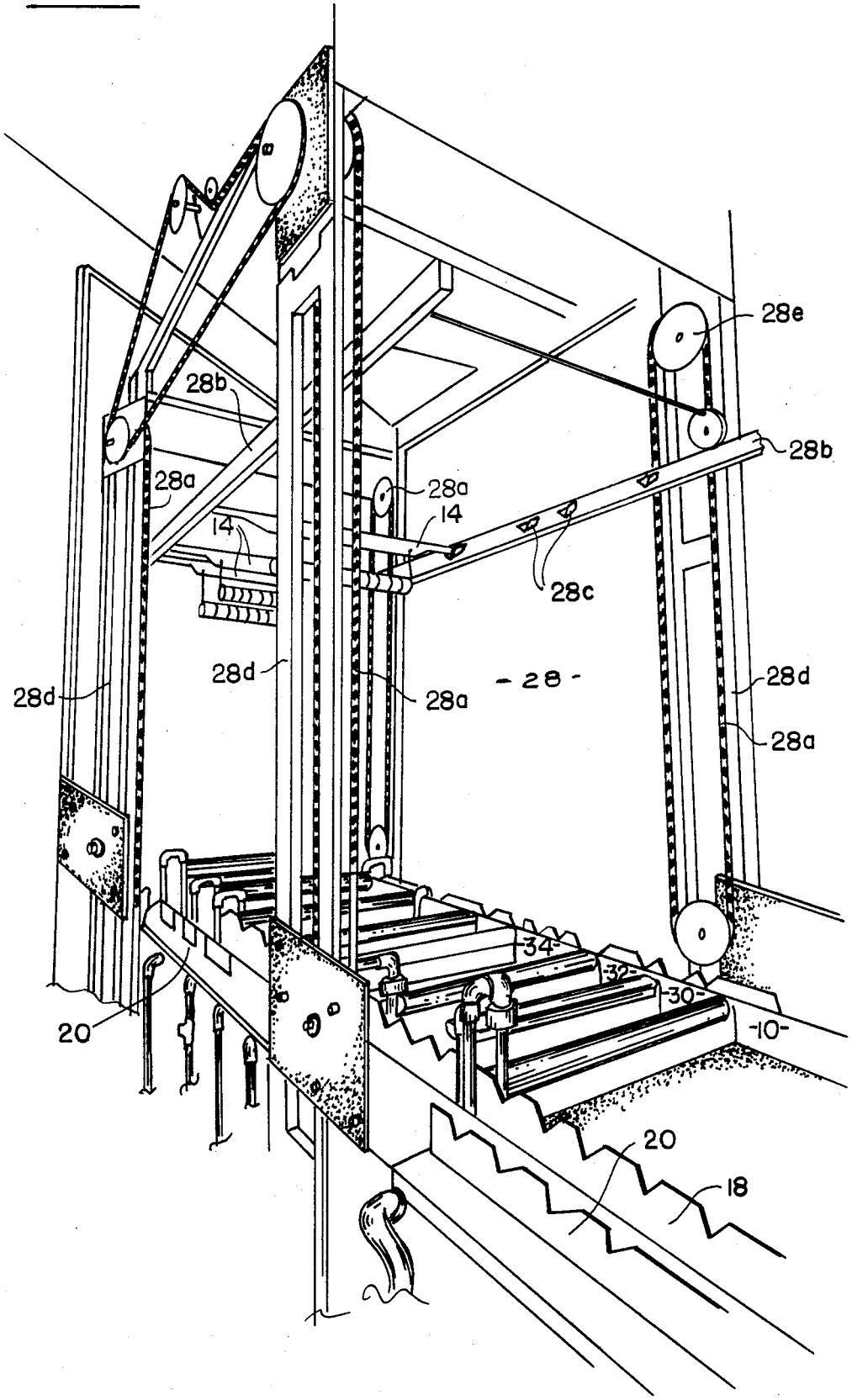
FIG. 4 is a perspective view taken slightly above and from the input end of the apparatus, and showing the series of processing tanks included in the apparatus, and the between-tank transporter for carrying the film from one tank to the next, and the in-tank transporter for causing the film to be immersed in the solutions in the various tanks for selected time intervals.

The between-tank transporter 28, as best shown in FIG. 4, includes two elongated horizontal side members 28*b* which extend along opposite sides of all of the tanks of the apparatus, with the exception of the developing tank 10, and which are lifted and lowered by a pair of vertical chain drives 28*a* mounted on the upright members 28*d*. The action is such that the side members 28*b* are lifted vertically upwardly and over the top of sprockets 28*e* included in the chain drives, and are moved forwardly a predetermined distance, and then lowered by the chain drives. The side members 28*b* then move back horizontally to their initial position, ready for the next cycle. The chain drives 28*a* of the transporter 28 are operated at predetermined time intervals, of, for example, 2 minutes, by an intermittently energized electric motor which is controlled by a timing clock mechanism (not shown). The in-tank transporter 18 is driven by the transporter 28 so that it too will operate on 2-minute intervals, each initiated when the side members 28*b* are in their uppermost positions.

The side members 28*b* have a number of V-shaped clips 28*c* mounted on their inner sides which are positioned under the ends of the racks 14 held in notches in strip 18 across any of the tanks of the apparatus subsequent to tank 10. The between-tank transporter 18, accordingly, is activated every two minutes by the timing clock mechanism, for example, to lift a rack 14 up to the position of FIG. 4, and raise the film F up and out of one tank, and then to cause the rack to be lowered and the film immersed into the next tank as the chains 28*a* loop around the upper sprockets 28*e*.

As mentioned above, and as shown in FIGS. 1 and 4, the next tank in the apparatus after tank 10 is the wash tank 30 which contains an appropriate wash solution. The racks 14 are carried by the between-tank transporter 28 from the developing tank 10 to the wash tank 30. Strip 18 has a single notch adjacent to tank 30, and a switch similar to the switches 22 of FIG. 3 is mounted in the notch to be actuated when a rack 14 is dropped into the notch. This switch serves to turn on the wash solution whenever film is immersed into the wash tank 13, to cause the solution to flow through the wash tank and to wash the film. At the end of 2 minutes, the between-tank transporter 28 is again activated by the time clock mechanism to lift the film F out of the wash tank 30, and to carry the film to the next tank 32 (FIGS. 3 and 4) which contains a reversal solution. Strip 18 has a single notch adjacent to tank 32, and the film is accordingly transported out of the reversal tank to the next tank 34 after a 2 minute interval.

Tank 34 contains the color developer solution. Strip 18 has three notches adjacent to tank 34, and rack 14 is advanced from the first notch to the second notch by the in-tank transporter 20 after a 2 minute interval. The rack is not picked up by the the between-tank transporter 28 until after it has been deposited into the third notch and, accordingly, the film suspended from the racks 14 is immersed in tank 34 for 6 minutes. The notches on strip 18 adjacent to tank 34 are also equipped with switches like switch 22 of FIG. 3 to cause nitrogen to be introduced into the solution in tank 34 every 30 seconds for agitating purposes, so long as film is immersed in the tank. The rack is not deposited in the third notch by in-tank transporter 20 unitl the between-tank transporter 28 is in its upper position, to assure that any preceding rack will have first been lifted out of the third notch by transporter 28.

It should be noted that a plurality of racks 14, each carrying film may proceed through the apparatus, one following the other, as shown in FIG. 4, so that a large quanity of film may be processed by the apparatus on a continuous basis, with the film carried by any particular rack 14 being immersed in the developing tank 10 for a predetermined time interval, as established by the computer, and which may differ from one rack to the next. It should also be noted that the 2-minute interval described above is for illustrative purposes only and other appropriate time intervals may be selected. Moreover, timing mechanisms other than a computer may be used to control the inserter 12.

Figure 5:
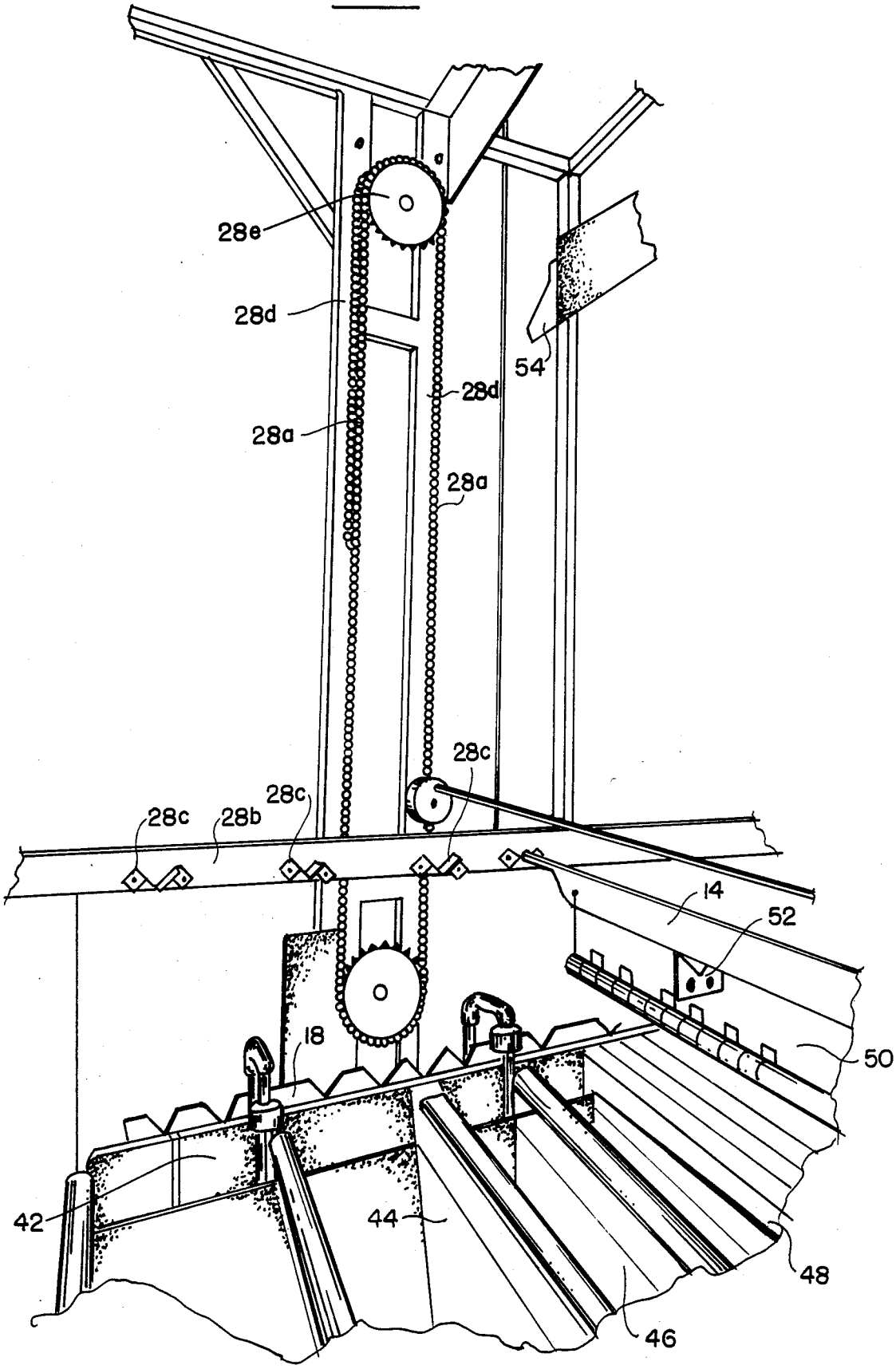
FIG. 5 is a perspective view of the output end of the apparatus.

In like manner, the film is transported to successive tanks 36, 38, 40, 42, 44, 46 (FIGS. 1 and 5) in the apparatus, which contain respectively a conditioner solution, a bleach solution, a fixer solution, a final wash, de-ionized rinse, and a stabilizer solution. As a final step in the apparatus, the film is suspended by each rack 14 in a compartment 48 for two minutes and allowed to drip. Then the rack 14 is picked up by the transporter 28 and placed on a pair of V-shaped brackets, such as bracket 52 of FIG. 5, to cause the film to be suspended in a warm air dryer 50. Each rack is transported to the drip compartment 48 by means of a pair of spring-biased slides, such as slide 54.

The fixer solution tank 40 includes a switch in the notch of strip 18, similar to switches 22, to turn on the dryer 50 when a rack 14 is received over the fixer tank. This assures that the dryer 50 will be warm when the film is subsequently placed in the dryer. The racks 14 and film are removed manually from the dryer 50, and the dryer is manually turned off after a selected time interval. The final wash and de-ionized rinse tanks 42, 44 include similar switches 22 to turn on the water when the film is received in those tanks.

The solutions in the developer tank 10, the reversal tank 32, the color developer tank 34, and in the conditioner, bleach and fixer tanks may be constantly recirculated, filtered and heated 24 hours a day.

To reiterate, during the operation of the apparatus, any particular film carried by a particular rack 14 is moved by inserter 12 up and along to a selected notch in strip 18 adjacent to tank 10, and dropped into the tank at a point in the 2 minute cycle of the transporter 20 so that after a predetermined time the transporter 20 will move the rack to the next notch of strip 18. Thereafter, at 2 minute intervals, the rack will be advanced from one notch to the next in strip 18 by the transporter 20 while the film remains in the developer solution in tank 10. Then, after the predetermined time interval of immersion of the film in the developer tank 10 has elasped, the transporter 28 moves the film to the next tank 30. The construction of the apparatus is such that although transporters 20, 28 operate at fixed time intervals, for example, at 2 minute intervals, different immersion times may be selected for different film in the developer tank 10, and provisions may be made in the subsequent tanks for the film to remain immersed either for 2 minutes in certain selected tanks, or for multiples of 2 minutes in other selected tanks.

In a typical example, film is inserted in the first wash tank 30 for two minutes, in the reversal tank 32 for two minutes, in the color developer tank 34 for six minutes, in the conditioner tank 36 for two minutes, in the bleach tank 38 for six minutes, in the fixer tank 40 for four minutes, in the final wash tank 42 for four minutes, in the de-ionized rinse tank 44 for two minutes, and in the stabilizer tank 46 for two minutes.

It will be appreciated that the inserter 12 of FIGS. 1, 2 and 3 may be used and retrofitted into other types of automatic film processors presently on the market.

While a particular embodiment of the invention has been shown and described, modifications may be made. It is intended in the following claims to cover all such modifications which come within the true spirit and scope of the invention.

I claim:

1. Apparatus for processing exposed photographic film, comprising: a series of tanks containing different solutions required for processing the film; a horizontally movable inserter positioned adjacent to a selected tank of the series; first drive means coupled to the inserter for moving the inserter to selectable positions along the selected tank; second drive means mounted on said inserter for receiving said film and for first moving said film from a loading position to an upper position in which the film is displaced up from the surface of the solution in the selected tank, and for then moving the film to a lower position in which the film is immersed in the solution in the selected tank; and control means connected to said first and second drive means to move said inserter to said selectable positions along the selected tank as determined by the processing requirements of different films to be processed and also to cause said second drive means to lower the film into the solution in the selected tank at selected predetermined intervals after the inserter has been moved to a selected position along the tank as also determined by the processing requirements of different films to be processed.

2. The apparatus defined in claim 1, and which includes an elongated rack for supporting the film removably mounted on said second drive means in position to extend transversely across the tanks; a first pair of elongated members extending along the respective sides of the series of tanks for receiving the rack when the film is moved to its lower position by said second drive means and to release the rack from the second drive means; transporter means including a second pair of elongated members mounted adjacent to the respective sides of the series of tanks; third drive means coupled to said transporter means to actuate said transporter means at preselected fixed time intervals so as to cause said second pair of elongated members at successive time increments to engage said rack and lift said rack up from the first pair of elongated members and move the rack forwardly in the first tank incrementally to successive positions on said first pair of elongated members with the film remaining immersed in the solution in the selected tank; and means for activating said second drive means at selectable times with respect to said preselected fixed time intervals as determined by the processing requirements of the film.

3. The apparatus defined in claim 2, in which said selected tank comprises the first tank of the series and contains a developer solution for the film.

4. The apparatus defined in claim 2, in which said control means includes computer means connected to said first and second drive means to cause said first drive means to move said inserter to a predetermined position along the first tank and to cause said second drive means to lower the rack onto said first pair of elongated members at a predetermined interval prior to the next actuation of said transporter means by said third drive means as determined by the processing requirements of the film.

5. The apparatus defined in claim 2, in which each of said elongated members of said first pair is shaped to provide a series of notches, with the rack being received in a selected notch in each of said elongated members of said first pair when it is lowered to its lower position by said second drive means, and with said rack being received in successive notches in each elongated member of said first pair as it is moved incrementally forward by said transporter means.

6. The apparatus defined in claim 5, and which includes a plurality of switches respectively mounted in the notches of at least one of the elongated members of said first pair to be operated by the rack when the rack is received in the corresponding notches so as to cause an agitating gas to be introduced into the solution in the selected tank.

7. The apparatus defined in claim 2, and which includes further transporter means mounted adjacent to successive tanks of said series for transporting said rack from one of the successive tanks of the series to the next.

8. The apparatus defined in claim 7, in which said further transporter means includes first and second elongated horizontal members extending along each side of the successive tanks of the series, fourth drive means for moving the elongated horizontal members vertically between a lower position and an upper position, and timing means for operating said fourth drive means at preselected fixed time intervals.

9. The apparatus defined in claim 8, and which includes means coupling said further transporter means to said first-named transporter means to drive said elongated members of said first-named transporter means at said preselected time intervals each commencing when said elongated horizontal members are in said upper position.

10. The apparatus defined in claim 8, in which each of said elongated horizontal members of said further transporter means includes a plurality of V-shaped clips mounted thereon and positioned therealong to engage the ends of said rack when said rack is at a predetermined position on said first pair of elongated members and to lift the rack to an upper position with the film being drawn up and out of the solution in the corresponding tank and to move the rack forward and then to a lower position in which the rack is again received by said first pair of elongated members with the film immersed in the solution in the next tank.

11. Apparatus for processing a photographic film comprising: a tank containing a solution required for processing the film; a horizontally movable inserter positioned adjacent to said tank; first drive means coupled to said inserter for moving said inserter to selectable positions along said tank; second drive means mounted on said inserter for receiving said film and for first moving said film from a loading position to an upper position in which the film is displaced up from the surface of the solution in the tank and for then moving the film to a lower position in which the film is immersed in the solution in the tank; and control means connected to said first and second drive means to move said inserter to said selectable positions along said tank as determined by the processing requirements of different films to be processed and also to cause said second drive means to lower the film into the solution in said tank at selected predetermined intervals after the inserter has been moved to a selected position along the tank as also determined by the processing requirements of the different films to be processed.

* * * * *